US009316977B2

(12) United States Patent
Yamano et al.

(10) Patent No.: US 9,316,977 B2
(45) Date of Patent: Apr. 19, 2016

(54) FIXING DEVICE AND IMAGE FORMING APPARATUS

(71) Applicants: Motoyoshi Yamano, Tokyo (JP); Tetsuo Tokuda, Kanagawa (JP); Takashi Sakamaki, Kanagawa (JP); Naoto Suzuki, Kanagawa (JP); Satoshi Ueno, Tokyo (JP); Kohichi Utsunomiya, Kanagawa (JP); Fumihiro Hirose, Kanagawa (JP)

(72) Inventors: Motoyoshi Yamano, Tokyo (JP); Tetsuo Tokuda, Kanagawa (JP); Takashi Sakamaki, Kanagawa (JP); Naoto Suzuki, Kanagawa (JP); Satoshi Ueno, Tokyo (JP); Kohichi Utsunomiya, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/204,268

(22) Filed: Mar. 11, 2014

(65) Prior Publication Data

US 2015/0227097 A1 Aug. 13, 2015

(30) Foreign Application Priority Data

Mar. 29, 2013 (JP) ..... 2013-072975

(51) Int. Cl.
*G03G 15/20* (2006.01)

(52) U.S. Cl.
CPC ..... *G03G 15/2057* (2013.01); *G03G 15/2017* (2013.01); *G03G 15/2039* (2013.01); *G03G 15/2053* (2013.01); *G03G 15/2078* (2013.01)

(58) Field of Classification Search
CPC ..... G03G 15/2017; G03G 15/2053; G03G 15/2039; G03G 15/2057; G03G 15/2078
See application file for complete search history.

(56) References Cited

U.S. PATENT DOCUMENTS

| | | | | |
|---|---|---|---|---|
| 7,965,970 | B2 * | 6/2011 | Haseba et al. | 399/329 |
| 2008/0226324 | A1 * | 9/2008 | Baba et al. | 399/69 |
| 2008/0226326 | A1 | 9/2008 | Seo et al. | |
| 2008/0232873 | A1 | 9/2008 | Ueno et al. | |
| 2009/0060550 | A1 | 3/2009 | Seo | |
| 2011/0262194 | A1 * | 10/2011 | Sone et al. | 399/329 |

FOREIGN PATENT DOCUMENTS

| | | |
|---|---|---|
| JP | 2000-030850 | 1/2000 |
| JP | 2001-135470 | 5/2001 |
| JP | 2007-264421 | 10/2007 |
| JP | 2007-279672 | 10/2007 |
| JP | 2008-046531 | 2/2008 |
| JP | 2008-216390 | 9/2008 |
| JP | 2008-224953 | 9/2008 |
| JP | 2008-233790 | 10/2008 |
| JP | 2008-257155 | 10/2008 |

(Continued)

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

A fixing device includes an exciting coil to generate a magnetic flux and a heat generation layer disposed opposite the exciting coil to generate heat by the magnetic flux from the exciting coil. A temperature sensitive magnetic body, disposed opposite the exciting coil via the heat generation layer, obtains and loses magnetism at a temperature defined by a Curie temperature by composition adjustment to selectively create a heating region and a non-heating region of the heat generation layer. A degausser is made of a non-magnetic material having an electrical resistivity smaller than an electrical resistivity of the temperature sensitive magnetic body. The degausser is disposed opposite the exciting coil with an interval in a range of from about 4.2 mm to about 8.2 mm.

13 Claims, 4 Drawing Sheets

(56) References Cited

FOREIGN PATENT DOCUMENTS

| | | |
|---|---|---|
| JP | 2009-058829 | 3/2009 |
| JP | 2009-092743 | 4/2009 |
| JP | 2011-085845 | 4/2011 |
| JP | 2011-221557 | 11/2011 |
| JP | 2013-003511 | 1/2013 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-072975, filed on Mar. 29, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may employ an induction heater to heat the recording medium quickly. For example, the induction heater heats a fixing rotary body, such as a fixing belt and a fixing roller, pressingly contacted by a pressure roller to form a fixing nip therebetween. As the recording medium bearing the toner image is conveyed through the fixing nip, the fixing rotary body and the pressure roller apply heat and pressure to the recording medium, thus melting and fixing the toner image on the recording medium. Since the fixing rotary body incorporates a heat generation layer that generates heat by a magnetic flux generated by an exciting coil of the induction heater, the fixing rotary body is heated to a desired fixing temperature to fix the toner image on the recording medium quickly.

However, the heat generation layer is thin and therefore may cause temperature variation of the fixing rotary body in an axial direction thereof. For example, after a plurality of small recording media is conveyed over the fixing rotary body continuously, both lateral ends of the fixing rotary body in the axial direction thereof may overheat because the small recording media are not conveyed over both lateral ends of the fixing rotary body in the axial direction thereof and therefore do not draw heat therefrom. Accordingly, the temperature of the fixing rotary body varies in the axial direction thereof. Consequently, as a large recording medium is conveyed over the fixing rotary body immediately after conveyance of the small recording media, temperature variation of the fixing rotary body may vary gloss of a toner image on the large recording medium.

To address this problem, a self temperature control to offset a magnetic flux with a repulsive magnetic flux may be used. For example, a magnetic shunt alloy may be interposed between the heat generation layer and a metal plate serving as a degausser. When the temperature of the magnetic shunt alloy reaches a Curie temperature, a magnetic flux from the exciting coil penetrates the metal plate, allowing the metal plate to generate a repulsive magnetic flux that offsets the magnetic flux from the exciting coil.

In order to achieve the self temperature control, the exciting coil is situated in proximity to the magnetic shunt alloy. However, since the heat generation layer is disposed between the exciting coil and the magnetic shunt alloy, the degausser is situated in proximity to the heat generation layer. Accordingly, the degausser draws heat from the heated magnetic shunt alloy, elongating a warm-up time to warm up the heat generation layer to a target temperature.

To address this problem, two solutions are proposed. For example, as a first solution, as shown in JP-2013-003511-A, a part of the degausser that is requested to offset a decreased amount of the magnetic fluxes from the exciting coil is isolated from the heat generation layer with an increased interval therebetween, thus preventing the degausser from drawing heat from the heat generation layer. As a second solution, as shown in JP-2009-058829-A, the degausser rotates by 180 degrees with respect to the exciting coil, decreasing the repulsive magnetic fluxes generated by the degausser and thereby facilitating heat generation of the heat generation layer.

However, if the degausser is distanced from the exciting coil with an increased interval therebetween, the self temperature control of the degausser may degrade. Conversely, if the degausser is distanced from the exciting coil with a decreased interval therebetween, the degausser draws heat from the heat generation layer, degrading heat generation efficiency of the heat generation layer. For example, as the degausser is situated closer to the heat generation layer, the degausser is susceptible to magnetic fluxes leaked from the magnetic shunt alloy, which cause the degausser to generate repulsive magnetic fluxes that obstruct heat generation of the heat generation layer. Additionally, since the degausser is requested to generate an increased amount of repulsive magnetic fluxes to prevent temperature variation of the heat generation layer, it is necessary to locate the degausser close to the heat generation layer.

Accordingly, it is requested to locate the degausser at a position where the degausser enhances heat generation efficiency of the heat generation layer while generating a sufficient amount of repulsive magnetic fluxes to prevent temperature variation of the heat generation layer.

SUMMARY

This specification describes below an improved fixing device. In one exemplary embodiment, the fixing device includes an exciting coil to generate a magnetic flux and a heat generation layer disposed opposite the exciting coil to generate heat by the magnetic flux from the exciting coil. A temperature sensitive magnetic body, disposed opposite the exciting coil via the heat generation layer, obtains and loses magnetism at a temperature defined by a Curie temperature by composition adjustment to selectively create a heating region and a non-heating region of the heat generation layer. A degausser is made of a non-magnetic material having an electrical resistivity smaller than an electrical resistivity of the temperature sensitive magnetic body. The degausser is disposed opposite the exciting coil with an interval in a range of from about 4.2 mm to about 8.2 mm.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
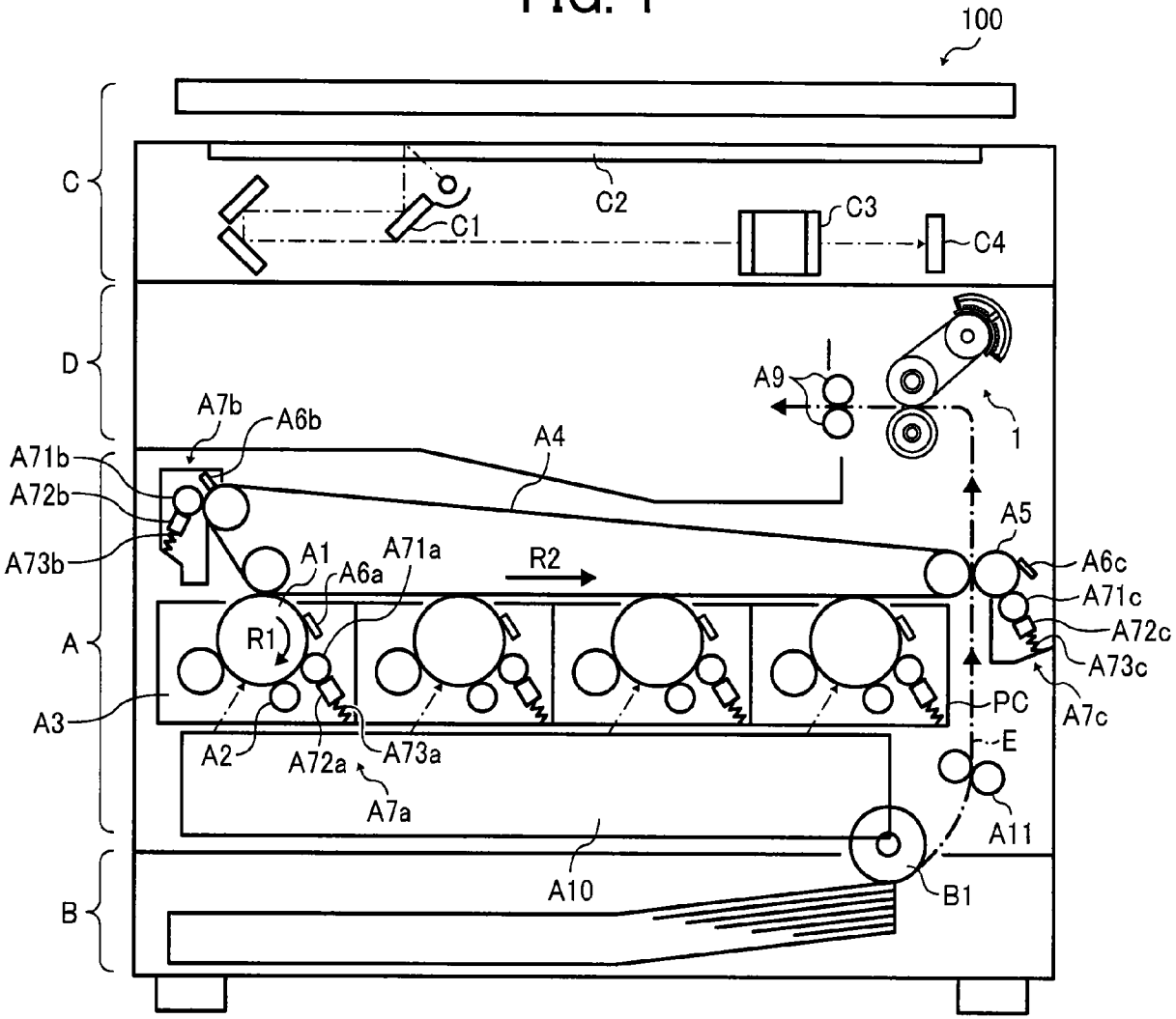
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color copier that forms color and monochrome toner images on recording media by electrophotography.

As shown in FIG. 1, the image forming apparatus 100 is a compact copier having an internal output tray accommodated inside a body of the image forming apparatus 100. The image forming apparatus 100 includes an image forming device A, situated at substantially a center of the image forming apparatus 100 in a vertical direction, that forms a toner image on a recording medium. Below the image forming device A is a sheet feeder B that feeds the recording medium to the image forming device A. Optionally, another sheet feeder may be located below the sheet feeder B.

Above the image forming device A is an internal output tray D that receives the recording medium bearing the toner image. Above the internal output tray D is a scanner C that reads an image on an original. A recording medium conveyance path E indicated by the dotted line extends from the sheet feeder B to the internal output tray D.

A detailed description is now given of a construction of the image forming device A.

The image forming device A includes four drum-shaped photoconductors A1 each of which is surrounded by components for forming a toner image. Taking the leftmost photoconductor A1 as an example, the photoconductor A1 rotatable in a rotation direction R1 is surrounded by a charger A2 that charges an outer circumferential surface of the photoconductor A1, an exposure device A10 that emits a laser beam onto the charged outer circumferential surface of the photoconductor A1 according to image data created by the scanner C, thus forming an electrostatic latent image on the photoconductor A1, and a development device A3 that develops the electrostatic latent image formed on the photoconductor A1 into a toner image.

In proximity to the four photoconductors A1 are an intermediate transfer belt A4 serving as an intermediate transferor and a secondary transferor A5. The toner images formed on the four photoconductors A1 are primarily transferred onto the intermediate transfer belt A4 such that the toner images are superimposed on a same position on the intermediate transfer belt A4 to form a color toner image thereon. The color toner image is secondarily transferred onto a recording medium conveyed from the sheet feeder B by the secondary transferor A5.

A cleaner A6*a* is disposed opposite the photoconductor A1 to remove residual toner failed to be transferred onto the intermediate transfer belt A4 and therefore remaining on the photoconductor A1 therefrom. A cleaner A6*b* is disposed opposite the intermediate transfer belt A4 to remove residual toner failed to be transferred onto the recording medium and therefore remaining on the intermediate transfer belt A4 therefrom. A cleaner A6*c* is disposed opposite the secondary transferor A5 to clean the secondary transferor A5. In proximity to the cleaner A6*a* is a lubricant applicator A1*a* that applies a lubricant onto the photoconductor A1 to decrease the friction coefficient of the outer circumferential surface of the photoconductor A1. Similarly, in proximity to the cleaner A6*b* is a lubricant applicator A1*b* that applies a lubricant onto the intermediate transfer belt A4 to decrease the friction coefficient of an outer circumferential surface of the intermediate transfer belt A4. In proximity to the cleaner A6*c* is a lubricant applicator A7*c* that applies a lubricant onto the secondary transferor A5 to decrease the frictional coefficient of an outer circumferential surface of the secondary transferor A5.

Downstream from the secondary transferor A5 on the recording medium conveyance path E is a fixing device 1 that fixes the color toner image secondarily transferred from the intermediate transfer belt A4 onto the recording medium thereon.

In order to facilitate maintenance, the photoconductor A1, the charger A2, the development device A3, the cleaner A6*a*, and the lubricant applicator A1*a* are integrated into a unit, that is, a process cartridge PC, detachably attached to the image forming apparatus 100. Similarly, the cleaner A6*b* and the lubricant applicator A1*b* are integrated into a unit detachably attached to the intermediate transfer belt A4. The cleaner A6*c*, the lubricant applicator A7*c*, and a secondary transfer roller used as the secondary transferor A5 are integrated into a unit detachably attached to the image forming apparatus 100. The recording medium bearing the fixed color toner image discharged from the fixing device 1 is discharged by an output roller pair A9 onto the internal output tray D which stocks the recording medium.

A detailed description is now given of conveyance of the recording medium to the image forming device A.

The sheet feeder B loads a plurality of new recording media and includes a feed roller B1 and a paper tray. As the feed roller B1 rotates, the feed roller B1 picks up and feeds an uppermost recording medium from the plurality of recording media loaded on the paper tray toward a registration roller pair A11. The registration roller pair A11 stops rotation temporarily to halt the recording medium conveyed from the feed roller B1 and resumes rotation to feed the recording medium such that a leading edge of the recording medium reaches a secondary transfer nip formed between the intermediate transfer belt A4 and the secondary transferor A5 at a time when the color toner image formed on the intermediate transfer belt A4 reaches the secondary transfer nip.

A description is provided of an image forming operation performed by the image forming apparatus 100 described above to form a color toner image on a recording medium.

The scanner C includes an exposure glass C2, a carriage C1, a lens C3, and a charge-coupled device (CCD) C4. As the carriage C1 constructed of a light source and mirrors moves back and forth, the light source irradiates an original placed on the exposure glass C2 with light. The light reflected by the original is deflected by the mirrors of the carriage C1 into the lens C3 and enters the CCD C4 situated downstream from the lens C3 in a light travel direction. Thus, an image on the original is read into an image signal by the CCD C4.

The image signal is digitalized and subject to image processing. Based on the processed signal, a laser diode of the exposure device A10 emits light onto the outer circumferential surface of the photoconductor A1, forming an electrostatic latent image thereon. For example, the light emitted from the laser diode reaches the photoconductor A1 through a polygon mirror and a lens.

The charger A2 includes a charging member (e.g., a charging roller) and a biasing member that biases the charging member against the photoconductor A1 with predetermined pressure. The charging member is constructed of a conductive shaft and a conductive elastic layer coating the conductive shaft. A voltage applicator applies a predetermined voltage to a gap between the conductive elastic layer of the charging member and the photoconductor A1 through the conductive shaft, thus charging the outer circumferential surface of the photoconductor A1.

The development device A3 includes an agitation screw, a development roller, and a development doctor. A developer containing toner, after being agitated sufficiently by the agitation screw, adheres to the development roller magnetically. The development doctor levels the developer on the development roller into a thin layer. The leveled developer moves to the electrostatic latent image formed on the photoconductor A1, visualizing the electrostatic latent image as a toner image.

A primary transfer roller electrically adheres the toner image onto the intermediate transfer belt A4. Residual developer, that is, residual toner, failed to be transferred onto the intermediate transfer belt A4 and therefore remaining on the photoconductor A1 is removed from the photoconductor A1 by the cleaner A6*a*. The lubricant applicator A1*a* includes a lubricant application roller A71*a* constructed of a metal shaft and a brush wound around the metal shaft.

The lubricant application roller A71*a* biases against a solid lubricant A72*a* under its weight. A biasing member A73*a* biases the solid lubricant A72*a* against the lubricant application roller A71*a*. The lubricant application roller A71*a*, as it rotates, scrapes fine powder off the solid lubricant A72*a* and applies the fine powder on the outer circumferential surface of the photoconductor A1. For example, the fine powder of the solid lubricant A72*a* is applied on substantially the entire outer circumferential surface of the photoconductor A1 that is greater than a cleaning area on the photoconductor A1 where the cleaner A6*a* cleans the photoconductor A1. The cleaning area on the photoconductor A1 is determined based on cleaning performance of the cleaner A6*a* or the like. Conversely, the solid lubricant A72*a* is applied to the entire area on the photoconductor A1 where the cleaning blade contacts the photoconductor A1.

The lubricant applicator A1*b* and the cleaner A6*b* are integrated into a transfer cartridge detachably attached to the image forming apparatus 100. A biasing member A73*b* biases a solid lubricant A72*b* against a lubricant application roller A71*b* (e.g., a brush roller) with predetermined pressure. The lubricant application roller A71*b*, as it rotates, scrapes fine powder off the solid lubricant A72*b* and applies the fine powder onto the outer circumferential surface of the intermediate transfer belt A4. Upstream from the lubricant applicator A1*b* in a rotation direction R2 of the intermediate transfer belt A4 is the cleaner A6*b* incorporating a brush roller and a cleaning blade that clean the intermediate transfer belt A4.

For example, the brush roller rotates in a direction identical to the rotation direction R2 of the intermediate transfer belt A4 to disperse a foreign substance from the outer circumferential surface of the intermediate transfer belt A4. The cleaning blade contacts the intermediate transfer belt A4 with predetermined angle and pressure to remove residual toner failed to be transferred onto the recording medium and therefore remaining on the intermediate transfer belt A4 therefrom.

Similarly, the cleaner A6*c* and the secondary transferor A5 are integrated into a transfer cartridge detachably attached to the image forming apparatus 100. The cleaner A6*c* removes residual toner remaining on the secondary transferor A5 therefrom. The lubricant applicator A7*c* includes a biasing member A73*c* that biases a solid lubricant A72*c* against a lubricant application roller A71*c* so that the lubricant application roller A71*c* applies fine powder scraped off the solid lubricant A72*c* onto the secondary transferor A5.

Figure 2:
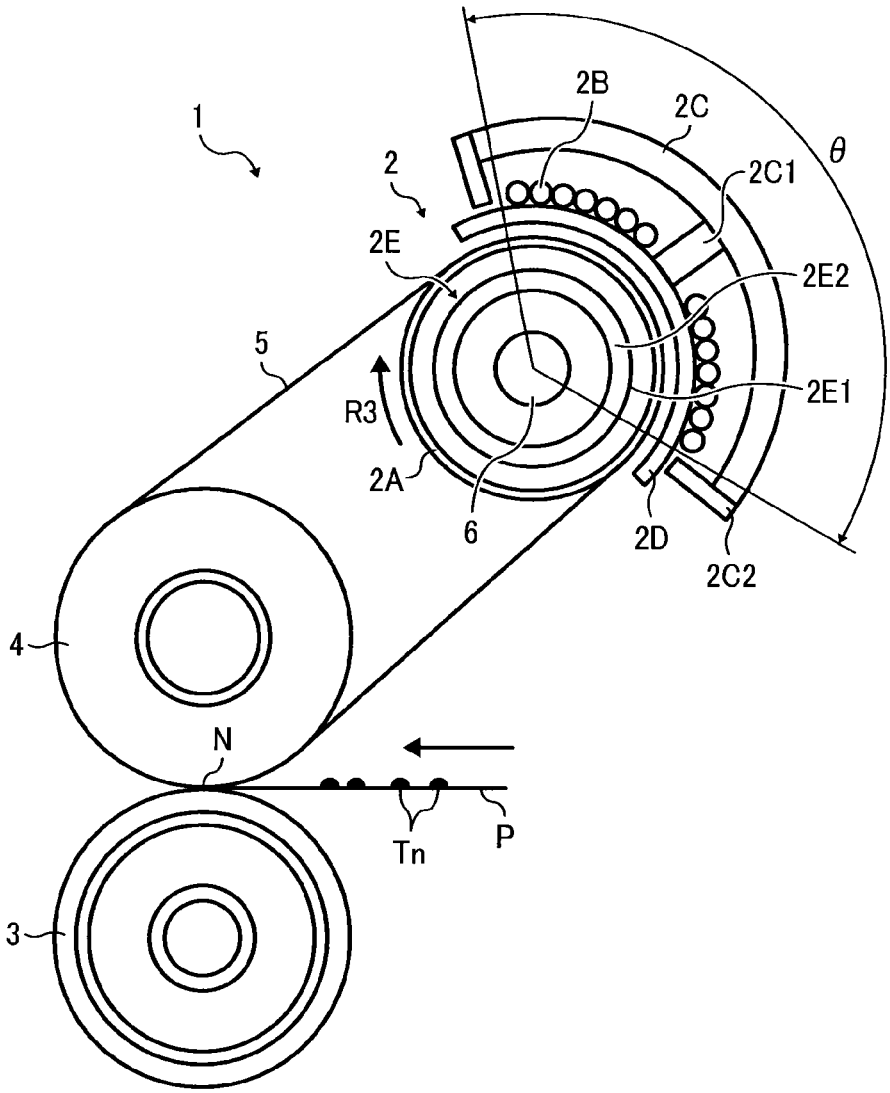
FIG. 2 is a schematic vertical sectional view of a fixing device incorporated in the image forming apparatus shown in FIG. 1.

With reference to FIG. 2, a description is provided of a construction of the fixing device 1 incorporated in the image forming apparatus 100 described above.

FIG. 2 is a vertical sectional view of the fixing device 1. As shown in FIG. 2, the fixing device 1 (e.g., a fuser) employs a belt fixing method using a fixing belt 5 looped over a fixing roller 4 and a heating roller 2A. The fixing roller 4 is disposed opposite a pressure roller 3 pressed against the fixing roller 4. A heating assembly 2 includes the hollow heating roller 2A rotatable in a rotation direction R3, a coil support 2D disposed opposite the heating roller 2A via the fixing belt 5, an exciting coil 2B supported by the coil support 2D and disposed opposite the fixing belt 5 via the coil support 2D, an arc core 2C disposed opposite the fixing belt 5 via the exciting coil 2B and the coil support 2D, and a degausser 2E disposed inside the hollow heating roller 2A.

Figure 3:
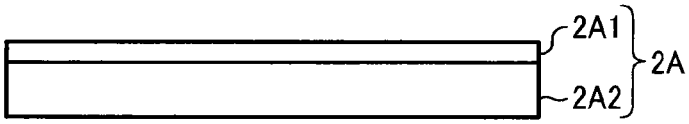
FIG. 3 is a sectional view of a heating roller incorporated in the fixing device shown in FIG. 2.

With reference to FIG. 3, a detailed description is now given of a construction of the heating roller 2A.

FIG. 3 is a sectional view of the heating roller 2A. As shown in FIG. 3, the heating roller 2A includes a heat generation layer 2A 1 and a temperature sensitive magnetic body 2A2 (e.g., a temperature sensitive magnetic layer) disposed opposite the exciting coil 2B via the heat generation layer 2A1. The heat generation layer 2A1 generates heat by induction heating as it receives a magnetic flux from the exciting coil 2B. The heat generation layer 2A1 coats a surface of the temperature sensitive magnetic body 2A2 by conductive plating such as copper plating and has a thickness in a range of from about 3 micrometers to about 20 micrometers, facilitating production of an eddy current and heat generation of the heat generation layer 2A1. For example, the heat generation layer 2A1 is made of copper, gold, or the like. Alternatively, the heat generation layer 2A1 may have a thickness of an upper limit of about 30 micrometers, that is, in a range of from about 3 micrometers to about 30 micrometers, thus facilitating generation of an eddy current that facilitates production of a repulsive magnetic flux.

The temperature sensitive magnetic body 2A2 is made of a magnetic shunt alloy. The magnetic shunt alloy is a magnetic material of which composition is adjusted such that the magnetic shunt alloy has a Curie temperature in a range of from about 100 degrees centigrade to about 300 degrees centigrade, for example, a magnetic shunt alloy material containing iron, nickel, or the like. The temperature sensitive magnetic body 2A2 obtains and loses magnetism below and above the Curie temperature. As the temperature sensitive magnetic body 2A2 obtains and loses magnetism, the temperature sensitive magnetic body 2A2 adjusts penetration of a magnetic flux through the heat generation layer 2A1, selectively creating a heating region and a non-heating region of the heat generation layer 2A1. For example, the heating region corresponds to a conveyance region of the fixing belt 5 where a recording medium P is conveyed, that is, a center span of the fixing belt 5 in an axial direction thereof. The non-heating region corresponds to a non-conveyance region of the fixing belt 5 where a recording medium P is not conveyed, that is, each lateral end span of the fixing belt 5 in the axial direction thereof.

According to this exemplary embodiment, the temperature sensitive magnetic body 2A2 is formed in a roller. Alternatively, the temperature sensitive magnetic body 2A2 may be formed in a film, an endless belt, or the like.

Accordingly, since the heating roller 2A incorporates the heat generation layer 2A1, the fixing belt 5 is constructed of a base layer made of polyimide resin. Although the fixing belt 5 does not incorporate a heat generation layer, the fixing belt 5 is heated to a predetermined temperature by the heating roller 2A.

With reference to FIG. 2, a detailed description is now given of a configuration of the exciting coil 2B.

The exciting coil 2B includes folded lateral ends in a longitudinal direction thereof parallel to an axial direction of the heating roller 2A, that is, turn portions, and extensions contiguously extending from the turn portions, respectively. The length of the exciting coil 2B including the extensions is equivalent to or greater than the width of a large recording medium (e.g., the width of an A3 size recording medium of 297 mm) in the axial direction of the heating roller 2A.

A detailed description is now given of a configuration of the arc core 2C.

As shown in FIG. 2, the arc core 2C includes a center core 2C1 situated at a center of the arc core 2C in a circumferential direction thereof and side cores 2C2 situated at both ends of the arc core 2C in the circumferential direction thereof. The exciting coil 2B is wound around the center core 2C1.

A detailed description is now given of a configuration of the degausser 2E.

As shown in FIG. 2, the degausser 2E is disposed opposite an outer circumferential surface of a shaft 6 rotatably mounting the heating roller 2A. The degausser 2E is made of a non-magnetic material and includes an arcuate opposed face 2E1 disposed opposite the exciting coil 2B and contoured to correspond to an inner circumferential surface of the heating roller 2A. The degausser 2E is a non-magnetic conductor made of aluminum, an alloy of aluminum, or copper that has an electrical resistivity smaller than that of the temperature sensitive magnetic body 2A2 of the heating roller 2A. The degausser 2E is a pipe or a tube corresponding to the tubular heating roller 2A. The degausser 2E includes an arch 2E2 having a center angle θ greater than an angle defined by a circumferential span of the exciting coil 2B disposed opposite the degausser 2E.

According to this exemplary embodiment, the degausser 2E is circular in cross-section as shown in FIG. 2. Alternatively, the degausser 2E may be arcuate in cross-section. When the temperature sensitive magnetic body 2A2 of the heating roller 2A selectively creates the heating region and the non-heating region of the heat generation layer 2A1, a magnetic flux reaching the degausser 2E generates an eddy current in the degausser 2E that generates a repulsive magnetic flux, preventing the magnetic flux penetrating through the heating roller 2A from penetrating through the shaft 6 disposed opposite the heating roller 2A via the degausser 2E.

Figure 4:
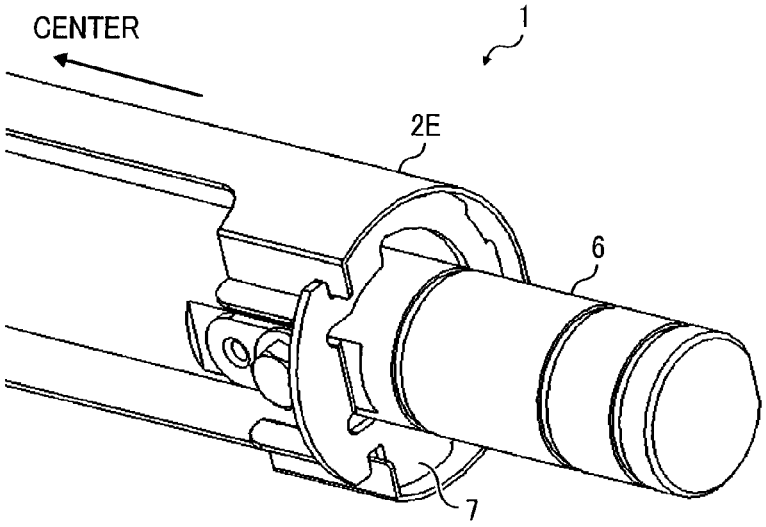
FIG. 4 is a partial perspective view of the fixing device shown in FIG. 2.

With reference to FIG. 4, a description is provided of a configuration of a holder 7 that supports the degausser 2E.

FIG. 4 is a partial perspective view of the fixing device 1 illustrating one lateral end of the degausser 2E in a longitudinal direction thereof parallel to the axial direction of the heating roller 2A. Although FIG. 4 does not illustrate another lateral end of the degausser 2E in the longitudinal direction thereof, both lateral ends of the degausser 2E in the longitudinal direction thereof are supported by the holder 7 situated inside the heating roller 2A incorporating the heat generation layer 2A1 such that the holder 7 is disposed opposite the exciting coil 2B via the heat generation layer 2A1 and the temperature sensitive magnetic body 2A2 of the heating roller 2A.

An inverter connected to the exciting coil 2B drives the exciting coil 2B at high frequency, causing the exciting coil 2B to produce a high frequency magnetic field, that is, a high frequency magnetic flux. The high frequency magnetic field moves an eddy current through the heat generation layer 2A1 of the heating roller 2A, thus increasing the temperature of the heating roller 2A. As shown in FIG. 2, as a recording medium P bearing a toner image Tn is conveyed through a fixing nip N formed between the pressure roller 3 and the fixing belt 5 looped over the fixing roller 4 and the heating roller 2A such that the toner image Tn faces the fixing belt 5, the fixing belt 5 heated by the heating roller 2A and the pressure roller 3 apply heat and pressure to the recording medium P, melting and fixing the toner image Tn on the recording medium P.

A detailed description is now given of a configuration of the pressure roller 3.

The pressure roller 3 serves as a driving roller for driving the fixing belt 5. The pressure roller 3 is pressed against the fixing roller 4 via the fixing belt 5 to form the fixing nip N between the pressure roller 3 and the fixing belt 5. As the recording medium P bearing the toner image Tn is conveyed through the fixing nip N, the pressure roller 3 drives and rotates the fixing belt 5 by friction therebetween.

A description is provided of a configuration of the fixing device 1 having the construction described above, that enhances heat generation efficiency and degaussing efficiency.

As shown in FIGS. 2 and 3, the fixing device 1 includes the heating roller 2A that incorporates the heat generation layer 2A1 and the temperature sensitive magnetic body 2A2 and the fixing belt 5 that does not incorporate a heat generation layer. The fixing device 1 has a configuration that enhances heat generation efficiency and degaussing efficiency as described below. For example, the degausser 2E is disposed opposite the exciting coil 2B with an interval in a range of from about 4.2 mm to about 8.2 mm.

Figure 5:
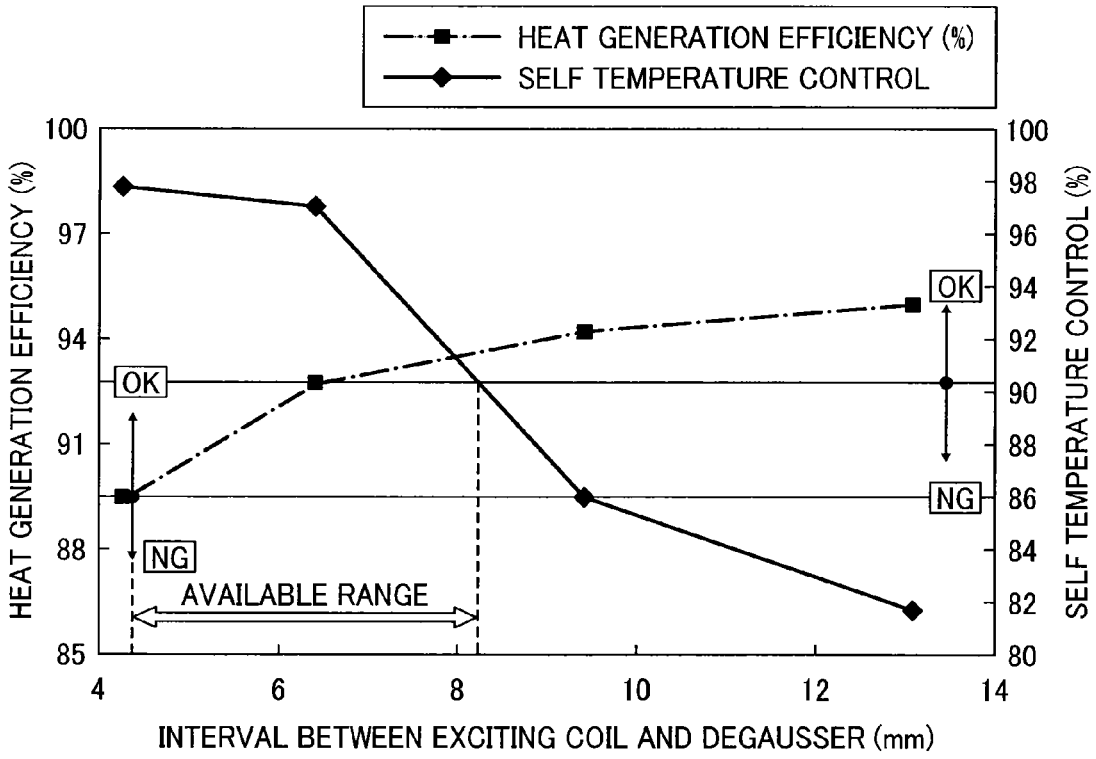
FIG. 5 is a graph showing a relation between an interval between an exciting coil and a degausser incorporated in the fixing device shown in FIG. 2 and heat generation efficiency of the heating roller and self temperature control of the degausser.

With reference to FIG. 5, a description is provided of an experiment for examining an influence of the interval between the exciting coil 2B and the degausser 2E upon a heat generation efficiency of the heat generation layer 2A1 of the heating roller 2A and a degaussing efficiency, that is, a self temperature control, of the degausser 2E.

FIG. 5 is a graph showing a relation between the interval between the exciting coil 2B and the degausser 2E and the heat generation efficiency of the heating roller 2A and the self temperature control of the degausser 2E. The self temperature control shown in FIG. 5 defines 100 percent as the upper limit temperature of 210 degrees centigrade of both lateral ends of the heating roller 2A in the axial direction thereof when both lateral ends of the heating roller 2A in the axial direction thereof are heated. The self temperature control is calculated according to a formula (1) below.

$$S=210/T\times100 \quad (1)$$

In the formula (1), S represents self temperature control as a percentage. T represents the upper limit temperature of both lateral ends of the heating roller 2A in the axial direction thereof. For example, when the upper limit temperature T of both lateral ends of the heating roller 2A in the axial direction thereof is 230 degrees centigrade, the self temperature control S is 91.3 percent.

An available range shown in FIG. 5 defines the upper limit temperature of both lateral ends of the heating roller 2A in the axial direction thereof in a range of from 214.7 degrees centigrade to 230.0 degrees centigrade. Since the heat generation efficiency of a halogen heater is smaller than about 90 percent, the available range shown in FIG. 5 defines a range in which the heating roller 2A demonstrates a desired fixing property, that is, the heating roller 2A is heated quickly to a desired fixing temperature, when the heat generation efficiency is 90 percent. When the heat generation efficiency is 90 percent at which the heating roller 2A demonstrates a desired fixing property in the available range, the temperature of both lateral ends of the heating roller 2A in the axial direction thereof is 214.7 degrees centigrade.

Based on the results of the experiment shown in FIG. 5, in order to enhance both the heat generation efficiency and the self temperature control, the interval between the exciting coil 2B and the degausser 2E is in a range of from about 4.2 mm to about 8.2 mm to employ the fixing belt 5 without a heat generation layer. Accordingly, even with the fixing belt 5 without a heat generation layer, the enhanced heat generation efficiency of the heating roller 2A shortens a warm-up time to warm up the fixing belt 5 to a desired fixing temperature to fix the toner image Tn on the recording medium P and prevents overheating of the fixing belt 5 at both lateral ends in the axial direction thereof. For example, after a plurality of recording media P is conveyed through the fixing nip N continuously, both lateral ends of the fixing belt 5 in the axial direction thereof may overheat because the small recording media P are not conveyed over both lateral ends of the fixing belt 5 in the axial direction thereof and therefore do not draw heat therefrom. To address this circumstance, the degausser 2E distanced from the exciting coil 2B with the interval as defined above prevents overheating of both lateral ends of the fixing belt 5 in the axial direction thereof.

Figure 6:
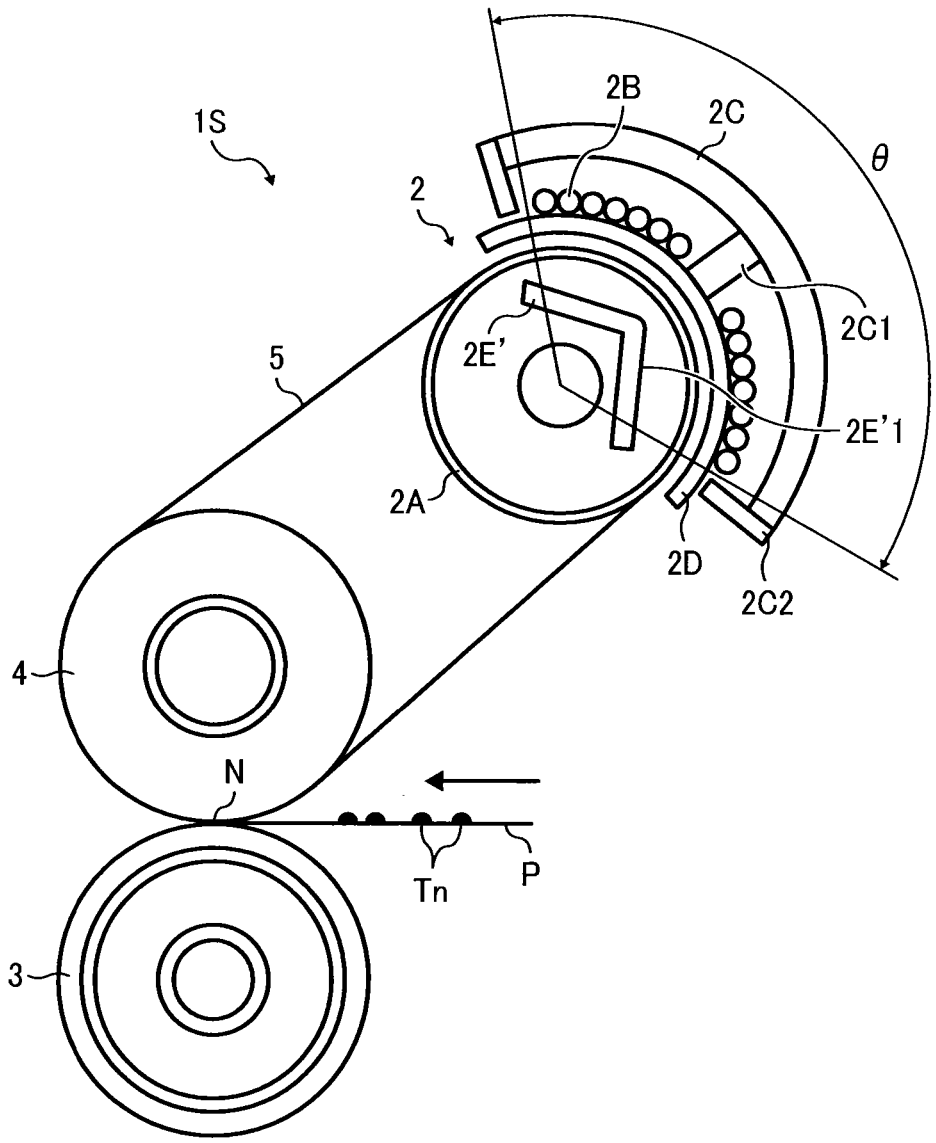
FIG. 6 is a vertical sectional view of a fixing device according to another exemplary embodiment of the present invention.

With reference to FIG. 6, a description is provided of a variation of the degausser 2E.

FIG. 6 is a vertical sectional view of a fixing device 1S incorporating a degausser 2E' as a variation of the degausser 2E shown in FIG. 2. As shown in FIG. 6, the degausser 2E' includes a linear, opposed face 2E'1 disposed opposite the exciting coil 2B. The linear, opposed face 2E'1 is manufactured by bending the degausser 2E', not by curving the degausser 2E' along the inner circumferential surface of the heating roller 2A into an arch, resulting in reduced manufacturing costs. As shown in FIG. 6, the degausser 2E' is bent at a single place. Alternatively, the degausser 2E' may be bent at a plurality of places to contour the opposed face 2E'1 into substantially an arch.

A description is provided of advantages of the fixing devices 1 and 1S.

As shown in FIGS. 2, 3, and 6, the fixing devices 1 and 1S include the exciting coil 2B, the heat generation layer 2A1 disposed opposite the exciting coil 2B, the temperature sensitive magnetic body 2A2 disposed opposite the exciting coil 2B via the heat generation layer 2A1, and a degausser (e.g., the degaussers 2E and 2E') disposed opposite the exciting coil 2B via the heat generation layer 2A1 and the temperature sensitive magnetic body 2A2. The exciting coil 2B generates a magnetic flux. The heat generation layer 2A1 generates heat by the magnetic flux from the exciting coil 2B. The temperature sensitive magnetic body 2A2 obtains and loses magnetism at a temperature defined by a Curie temperature by composition adjustment. The degausser is made of a non-magnetic material having an electrical resistivity smaller than that of the temperature sensitive magnetic body 2A2. As the temperature sensitive magnetic body 2A2 obtains and loses magnetism, the temperature sensitive magnetic body 2A2 adjusts penetration of the magnetic flux through the heat generation layer 2A1, selectively creating the heating region and the non-heating region of the heat generation layer 2A1. The degausser is distanced from the exciting coil 2B with an interval in a range of from about 4.2 mm to about 8.2 mm.

Accordingly, the interval between the exciting coil 2B and the degausser defined as above satisfies heat generation efficiency of the heat generation layer 2A1 and degaussing efficiency of the degausser to achieve the self temperature control.

According to the exemplary embodiments described above, the fixing devices 1 and 1S include the fixing belt 5 looped over the heating roller 2A and the fixing roller 4. Alternatively, the fixing devices 1 and 1S may not include the fixing belt 5 and the fixing roller 4. In this case, the pressure roller 3 is pressed against the heating roller 2A to form the fixing nip N therebetween through which the recording medium P bearing the toner image Tn is conveyed.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an exciting coil to generate a magnetic flux;

a heat generation layer disposed opposite the exciting coil to generate heat by the magnetic flux from the exciting coil;

a temperature sensitive magnetic body disposed opposite the exciting coil via the heat generation layer, the temperature sensitive magnetic body to obtain and lose magnetism at a temperature defined by a Curie temperature by composition adjustment to selectively create a heating region and a non-heating region of the heat generation layer; and a degausser made of a non-magnetic material having an electrical resistivity smaller than an electrical resistivity of the temperature sensitive magnetic body, the degausser disposed opposite the exciting coil with an interval in a range of from about 4.2 mm to about 8.2 mm, wherein the heat generation layer and the temperature sensitive magnetic body are tubular, wherein the degausser includes an opposed face disposed opposite the exciting coil and contoured to correspond to an inner circumferential surface of the temperature sensitive magnetic body, and wherein the opposed face of the degausser is arcuate.

2. The fixing device according to claim 1, wherein the heat generation layer is made of one of gold and copper.

3. The fixing device according to claim 1, wherein the heat generation layer has a thickness in a range of from about 3 micrometers to about 30 micrometers.

4. The fixing device according to claim 1, wherein the degausser is made of a non-magnetic conductor.

5. The fixing device according to claim 4, wherein the non-magnetic conductor of the degausser is made of one of aluminum and copper.

6. The fixing device according to claim 1, wherein the degausser is tubular.

7. The fixing device according to claim 1, wherein the degausser includes an arch having a center angle greater than an angle defined by a circumferential span of the exciting coil disposed opposite the degausser.

8. The fixing device according to claim 1, further comprising a holder, disposed opposite the exciting coil via the heat generation layer and the temperature sensitive magnetic body, to support the degausser.

9. The fixing device according to claim 1, further comprising:

a heating roller including the heat generation layer and the temperature sensitive magnetic body; and a shaft rotatably mounting the heating roller and disposed opposite the heating roller via the degausser.

10. An image forming apparatus comprising the fixing device according to claim 1.

11. The fixing device according to claim 1, further comprising:

a tubular heating roller including the heat generation layer and the temperature sensitive magnetic body, the tubular heating roller being rotatable.

12. The fixing device according to claim 1, further comprising:

a tubular heating roller including the heat generation layer and the temperature sensitive magnetic body;

a fixing roller; and a fixing belt looped over the heating roller and the fixing roller.

13. A fixing device comprising:

an exciting coil to generate a magnetic flux;

a heat generation layer disposed opposite the exciting coil to generate heat by the magnetic flux from the exciting coil;

a temperature sensitive magnetic body disposed opposite the exciting coil via the heat generation layer, the temperature sensitive magnetic body to obtain and lose magnetism at a temperature defined by a Curie temperature by composition adjustment to selectively create a heating region and a non-heating region of the heat generation layer; and a degausser made of a non-magnetic material having an electrical resistivity smaller than an electrical resistivity of the temperature sensitive magnetic body, the degausser disposed opposite the exciting coil with an interval in a range of from about 4.2 mm to about 8.2 mm, wherein the heat generation layer and the temperature sensitive magnetic body are tubular, and wherein the degausser is tubular.

* * * * *